US009315032B2

(12) United States Patent
et al.

(10) Patent No.: US 9,315,032 B2
(45) Date of Patent: Apr. 19, 2016

(54) PRINT APPARATUS

(71) Applicant: SEIKO EPSON CORPORATION, Tokyo (JP)

(72) Inventors: Pujiatno , Jawa Barat (ID); Riky Yonathan, Jawa Barat (ID)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/562,931

(22) Filed: Dec. 8, 2014

(65) Prior Publication Data

US 2015/0158305 A1 Jun. 11, 2015

(30) Foreign Application Priority Data

Dec. 9, 2013 (JP) ..... 2013-254325

(51) Int. Cl.
*B41J 2/175* (2006.01)
*B41J 2/165* (2006.01)

(52) U.S. Cl.
CPC ..... *B41J 2/175* (2013.01); *B41J 2/17509* (2013.01)

(58) Field of Classification Search
USPC ..... 347/5, 9, 14, 32, 85
See application file for complete search history.

(56) References Cited

U.S. PATENT DOCUMENTS

| | | | | |
|---|---|---|---|---|
| 7,533,959 | B2 * | 5/2009 | Ouchi et al. | 347/37 |
| 7,585,123 | B2 * | 9/2009 | Ueda et al. | 400/56 |
| 7,641,301 | B2 * | 1/2010 | Hayamizu et al. | 347/19 |
| 7,821,685 | B2 * | 10/2010 | Yoshihisa | 358/497 |

FOREIGN PATENT DOCUMENTS

JP 2012-131036 A 7/2012

* cited by examiner

*Primary Examiner* — Anh T. N. Vo
(74) *Attorney, Agent, or Firm* — Global IP Counselors, LLP

(57) ABSTRACT

A print apparatus includes a carriage configured to move reciprocally along one direction; a liquid supply tube, one end thereof being connected to the carriage; a housing in an interior of which the carriage and at least a part of the liquid supply tube are arranged; and a control unit configured to control reciprocal movement of the carriage. The liquid supply tube is connected to the carriage from a counter-home position side that is the opposite side in the one direction to a home position side at which the carriage is located before the start of printing. The control unit carries out a movement control, before the start of printing, to cause the carriage to move at a first speed toward the counter-home position side from the home position side, and then to move at a second speed faster than the first speed toward the home position side.

8 Claims, 6 Drawing Sheets

PRINT APPARATUS

CROSS-REFERENCE TO RELATED APPLICATIONS

This application claims priority to Japanese Patent Application No. 2013-254325 filed on Dec. 19, 2013. The entire disclosure of Japanese Patent Application No. 2013-254325 is hereby incorporated herein by reference.

BACKGROUND

1. Technical Field

The present invention relates to a print apparatus for printing by discharging a liquid supplied through a liquid supply tube onto a target.

2. Related Art

One conventionally known kind of print apparatus is an inkjet printer that prints by discharging ink, which is one example of a liquid, onto a target such as paper from a liquid discharge head. Such a printer prints images, including text and graphics, by discharging the ink from the liquid discharge head, which is loaded onto a carriage that moves reciprocally in a scan direction intersecting with a direction of conveyance of the paper, onto the paper, which is conveyed in one direction, within a housing thereof.

In a case where a relatively large amount of printing is being carried out, such a printer is provided with a liquid tank having a relatively large ink storage capacity in order to continuously and stably supply the ink to the liquid discharge head. A liquid supply tube establishing a connection between the liquid tank and the carriage is arranged inside the housing, and the ink is supplied to the liquid discharge head, which is loaded onto the carriage, through this liquid supply tube (for example, see Japanese Laid-Open Patent Publication No. 2012-131036).

SUMMARY

With such a printer, the liquid supply tube arranged inside the housing will include a portion that moves along with the carriage in association with when the carriage moves from a home position side (zero length side), which is located before printing is started on the paper, toward a destination side (full length side) after the start of printing in the scan direction. As such, the liquid supply tube must be arranged inside the housing of the print apparatus such that the moving portion thereof does not hinder the movement of the carriage.

However, in the printer, a first opening section for exposing the carriage located at the home position so as to be viewable may in some instances be formed in the housing, for the purpose of accessing the carriage before the start of printing, for example. In an alternative example, a second opening section for at least partially exposing a movement region of the carriage may likewise in some instances be formed in the housing for the purpose of performing maintenance, such as taking out an obstacle (for example, paper that has become jammed) that is present in the movement region of the carriage.

In such a case, for example, during the conveyance of the printer, it could happen that a part of the liquid supply tube arranged in the housing leaves a predetermined position of arrangement inside the housing, thus entering a state of protruding out to outside the housing from the first opening section, or a state of having moved to the second opening section side. There is the risk that, having entered such a state, the liquid supply tube could enter a so-called jammed state when the carriage moves for the purpose of printing, where the portion that protrudes out to outside the housing from the first opening section does not return inside the housing but rather remains bent, thus hindering the movement of the carriage. Alternatively, there is the risk that the portion that has left the predetermined position of arrangement inside the housing and moved to the second opening section side could enter the movement region of the carriage and hinder the movement of the carriage.

This is a situation that in general applies similarly to any print apparatus provided with a carriage that has a liquid discharge head and can be moved reciprocally along one direction, a liquid supply tube that has one end connected to the carriage and is capable of supplying a liquid to the liquid discharge head, and a housing in the interior of which the carriage and at least a part of the liquid supply tube are arranged.

The present invention has been made in view of the aforementioned situation, and one object is to provide a print apparatus with which a liquid supply tube that has left a position of arrangement inside a housing can be returned to the position of arrangement inside the housing in association with movement of a carriage.

Means for solving the problem shall be described below, as shall effects thereof.

A print apparatus according to one aspect includes a carriage, a liquid supply tube, a housing and a movement control unit. The carriage has a liquid discharge head configured and arranged to discharge a liquid and to move reciprocally along one direction. The liquid supply tube is configured and arranged to supply the liquid to the liquid discharge head. One end of the liquid supply tube is connected to the carriage. The carriage and at least a part of the liquid supply tube are arranged in an interior of the housing. The movement control unit is configured to control reciprocal movement of the carriage. The liquid supply tube is connected to the carriage from a counter-home position side that is an opposite side in the one direction to a home position side at which the carriage is located before start of printing in which the liquid is discharged onto a target from the liquid discharge head. The movement control unit is configured to carry out a movement control, before the start of printing, to cause the carriage to move at a first speed toward the counter-home position side from the home position side, and then to move at a second speed faster than the first speed toward the home position side from the counter-home position side.

According to this configuration, in a case where the liquid supply tube has left a position of arrangement inside the housing and entered a state that hinders the movement of the carriage, the liquid supply tube can be returned to the position of arrangement in association with movement of the carriage before the start of printing.

In the print apparatus, the housing preferably includes a first opening section through which the one end of the liquid supply tube connected to the carriage is exposed so as to be viewable when the carriage is located at a home position, the first opening section having an opening edge extending in a direction intersecting with a direction of movement of the carriage at a counter-home position-side rim portion thereof. The movement control unit is preferably configured to carry out the movement control within a range of motion of the carriage from the home position until when the one end of the liquid supply tube overlaps in the one direction with the opening edge of the first opening section.

According to this configuration, a liquid supply tube with which a tube portion of one part has protruded out of the housing via the first opening section can have the protruding tube portion returned to the position of arrangement inside the housing in association with the movement of the carriage before the start of printing.

In the print apparatus, the housing preferably includes a second opening section through which at least a part of a movement region of the carriage that moves during the printing is exposed so as to be viewable, the second opening section having an opening edge extending along the one direction at a position where the liquid supply tube connected to the carriage is not exposed. The movement control unit is preferably configured to carry out the movement control within a range of motion of the carriage from a position of the carriage before the start of printing until when the carriage enters a state of being at least partially exposed at the second opening section.

According to this configuration, the second opening section makes it possible to view a liquid supply tube that has protruded out into the movement region of the carriage from the position of arrangement. It is also possible to reliably carry out the movement control for returning, to the position of arrangement, a liquid supply tube that has protruded out into the movement region of the carriage, due to the carriage having moved until a state of being exposed at the second opening section.

In the print apparatus, preferably, the second opening section has an opening surface area of a size that allows for the target inside the housing to be taken out of the housing.

According to this configuration, a liquid supply tube that has protruded out into the movement region of the carriage from the position of arrangement can be easily viewed from the second opening section, and also, for example, a jammed target can be removed by being taken out of the housing from the second opening section.

In the print apparatus, preferably, provided to the housing along the one direction is a rib for retaining the liquid supply tube at a position apart from the movement region of the carriage by coming into contact with the liquid supply tube connected to the carriage when the carriage is moving reciprocally, the movement control unit carrying out the movement control within a range of motion of the carriage that allows for the liquid supply tube to be contacted with the rib.

According to this configuration, when a liquid supply tube that has protruded out into the movement region of the carriage from the position of arrangement inside the housing is returned to the position of arrangement inside the housing by the movement control of the carriage, there is a higher probability of the liquid supply tube staying returned to the position of arrangement.

In the print apparatus, preferably, a curved section is formed in the liquid supply tube, and tube portions located at both ends of the curved section are disposed inside the housing in a state where at least a part of one of the tube portions overlaps with the other tube portion as seen from the normal direction of a support surface of a support base for supporting the target.

According to this configuration, a liquid supply tube that has moved in the direction running along the support surface and left the position of arrangement inside the housing can be returned at high probability to the position of arrangement due the tube portions arranged so as to overlap in the normal direction of the support surface.

In the print apparatus, preferably, there are a plurality of the liquid supply tubes provided successively in a direction running along the support surface of the support base for supporting the target, and arranged in the housing in a state extending in a direction that intersects with a direction of succession of the liquid supply tubes and runs along the direction of movement of the carriage.

According to this configuration, a plurality of liquid supply tubes can be returned to the position of arrangement inside the housing at the same time by the movement control.

BRIEF DESCRIPTION OF THE DRAWINGS

Referring now to the attached drawings which form a part of this original disclosure.

DETAILED DESCRIPTION OF EXEMPLARY EMBODIMENTS

An inkjet printer that is provided with a liquid discharge head for discharging ink serving as one example of a liquid and prints images, including text and graphics, by discharging the ink onto paper serving as one example of a target shall be described below with reference to the accompanying drawings, as one embodiment of a print apparatus.

Figure 1:
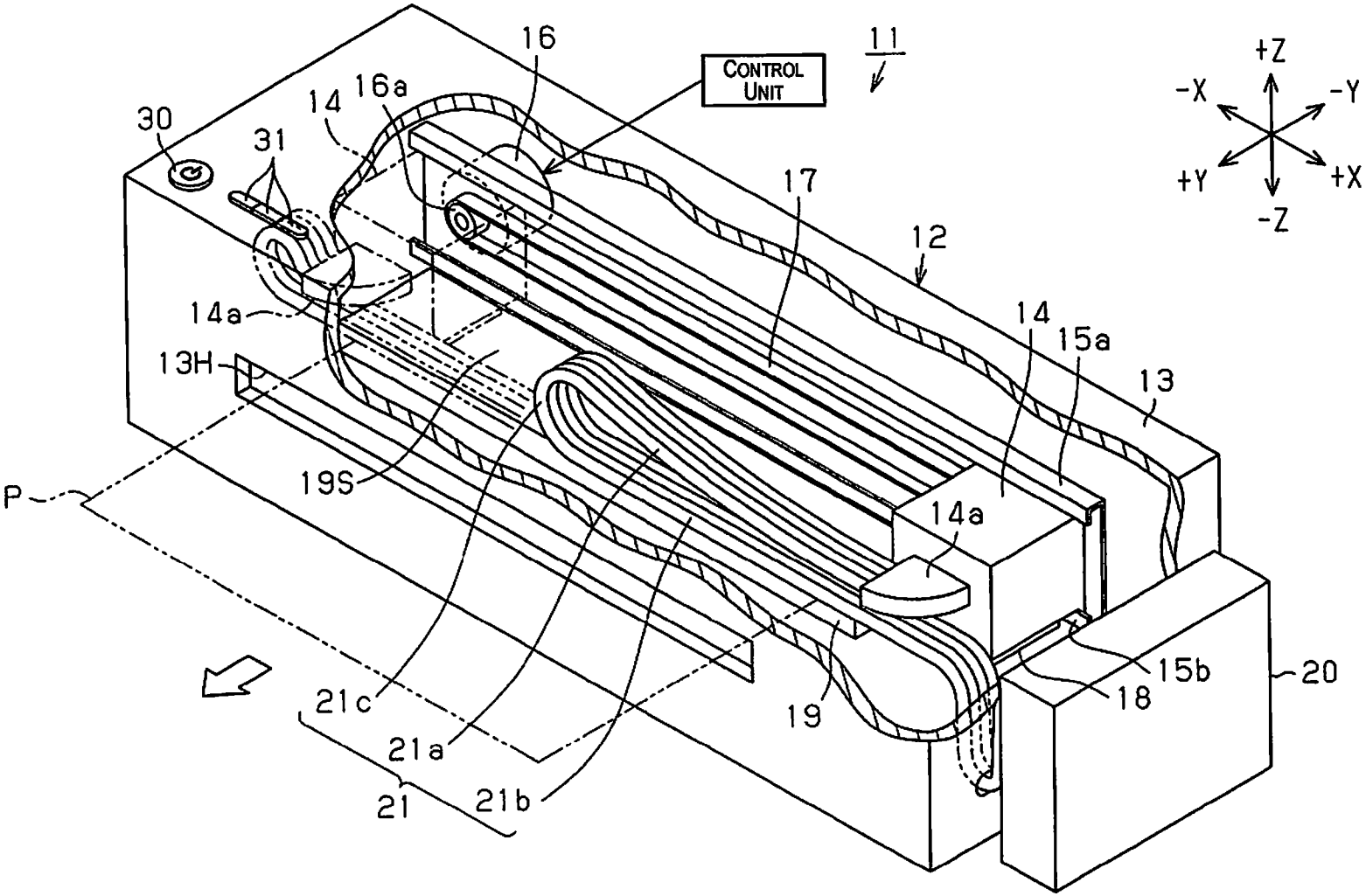
FIG. 1 is a perspective view illustrating a printer serving as one example of an embodiment of a print apparatus.

As illustrated in FIG. 1, a printer 11 of the present embodiment has: a printer main body 12 provided with a case body 13 as a housing, the case body being of a substantially rectangular parallelepiped shape for which one direction is understood to be the longitudinal direction; and an ink tank 20, which is provided separately from the printer main body 12 and is one example of a liquid storage section. FIG. 1 depicts the case body 13 in a partially broken state.

In the printer main body 12, a carriage 14 to which a liquid discharge head 18 is attached at a lower side, which is the gravitational direction (−Z direction) side, is arranged inside the case body 13 in a state allowing for reciprocal movement where the longitudinal direction of the case body 13 is the one direction (±X direction). Namely, the carriage 14 is capable of sliding along two guide rails 15*a*, 14*b* while being supported by the guide rails 15*a*, 15*b*, which extend in the one direction. The carriage 14 has a part that is fixed to an endless drive belt 17 spanned between a drive pulley 16*a*, which is rotated by a drive source 16 such as a motor, and a driven pulley (not shown). Driving of the drive source 16 by a control unit (not shown) provided inside the printer main body 12 causes the drive belt 17 to rotate, thus causing the carriage 14, which is fixed to the drive belt 17, to move along the guide rails 15*a*, 15*b* between a position illustrated with a solid line in FIG. 1 and a position illustrated with a two-dot chain line.

This movement of the carriage 14 causes the liquid discharge head 18 to move reciprocally, where the one direction is a scan direction (±X direction).

With the printer 11, a power source is turned on by a power source button 30 provided to the case body 13, following which a print operation is carried out onto paper P by operation of operation buttons 31. In more a detailed description, the paper P is supported from below by a support surface 19S on a side in the opposite direction to gravity (+Z direction) of a support base 19 provided inside the case body 13. Then, while remaining supported on the support surface 19S, the paper P is conveyed with the direction of conveyance (+Y direction) being a direction that intersects with the scan direction (±X direction) of the liquid discharge head 18 and that goes from the side of the two guide rails 15*a*, 15*b* with respect to the carriage 14 toward the opposite side thereof. Printing is carried out onto this conveyed paper P by discharging ink as appropriate from the liquid discharge head 18, which moves in the scan direction, onto the paper P. The printed paper P is conveyed toward a discharge port 13H provided to the front side of the case body 13, this being the side of the direction of conveyance of the paper P, and is discharged to outside the case body 13 from the discharge port 13H.

The ink tank 20 functions as a liquid storage section storing the ink that is discharged from the liquid discharge head 18 during printing, and is provided to the case body 13 outside in the right direction (+X direction as seen from the side of the direction of conveyance (+Y direction) of the paper P. A plurality (herein, four) of liquid supply tubes 21 for supplying the ink stored in the ink tank 20 to the carriage 14 are connected to between the carriage 14 inside the case body 13 and the ink tank 20 outside the case body 13. As such, the liquid supply tubes 21 are arranged at least partially inside the case body 13 of the printer main body 12.

In the present embodiment, each of the liquid supply tubes 21 has one end connected to a tube connection section 14*a* provided so as to protrude to the front side, this being the direction of conveyance (+Y direction) of the paper P, in the carriage 14, as well as another end connected to the ink tank 20. In a more detailed description, the one end of each of the liquid supply tubes 21 is connected to the tube connection section 14*a* from a counter-home position side (−X direction side), this being the opposite side in the scan direction to a home position side (+X direction side), at which the carriage 14 is located before the start of printing by discharging the ink onto the paper P from the liquid discharge head 18. Ink that has flowed into the tube connection section 14*a* from the ink tank 20 via each of the connected liquid supply tubes 21 flows through the tube connection section 14*a* and an ink flow path (not shown) provided to carriage 14, and is supplied to the liquid discharge head 18.

Each of the liquid supply tubes 21 is arranged in a state of being successive in a direction running along the support surface 19S of the support base 19 inside the case body 13. The liquid supply tubes 21 are also arranged inside the case body 13 in a state where a direction of extension of the tubes, which intersects with the direction of succession of each of the liquid supply tubes 21, runs along the direction of movement of the carriage 14, i.e., along the scan direction (±X direction). Formed in the liquid supply tubes 21 are curved sections 21*c* at which a convex surface goes toward the counter-home position direction (−X direction) at a portion on the upstream side from the tube connection section 14*a* of the carriage 14. The liquid supply tubes 21 are also arranged in a state where portions located at both ends of the curved sections 21*c*—namely, an upper tube portion 21*a* that is one tube portion located on the downstream side from the curved section 21*c*, and a lower tube portion 21*b* that is another tube portion located on the upstream side—overlap with one another as seen from the normal direction of the support surface 19S of the support base 19. More specifically, the upper tube portion 21*a* that is located on the downstream side from the curved section 21*c* is arranged in a state of overlap from above with respect to a part of the lower tube portion 21*b* that is located on the upstream side from the curved section 21*c*, while also having a change in the length along the scan direction (±X direction) in association with the movement of the carriage 14.

That is to say, in the liquid supply tubes 21, the tubes extending to the counter-home position side from the home position side are looped back by the curved sections 21*c*, thus making the upper tube portions 21*a*, which extend to the home position side from the curved sections 21*c*, and the lower tube portions 21*b*, which extend to the home position side from the curved sections 21*c*. A terminus (one end) of the upper tube portions 21*a* looped back in this manner is connected to the tube connection section 14*a* of the carriage 14.

As such, the curved sections 21*c* function as deforming movable sections that move while also undergoing deformation following the movement of the carriage 14.

Figure 2A:
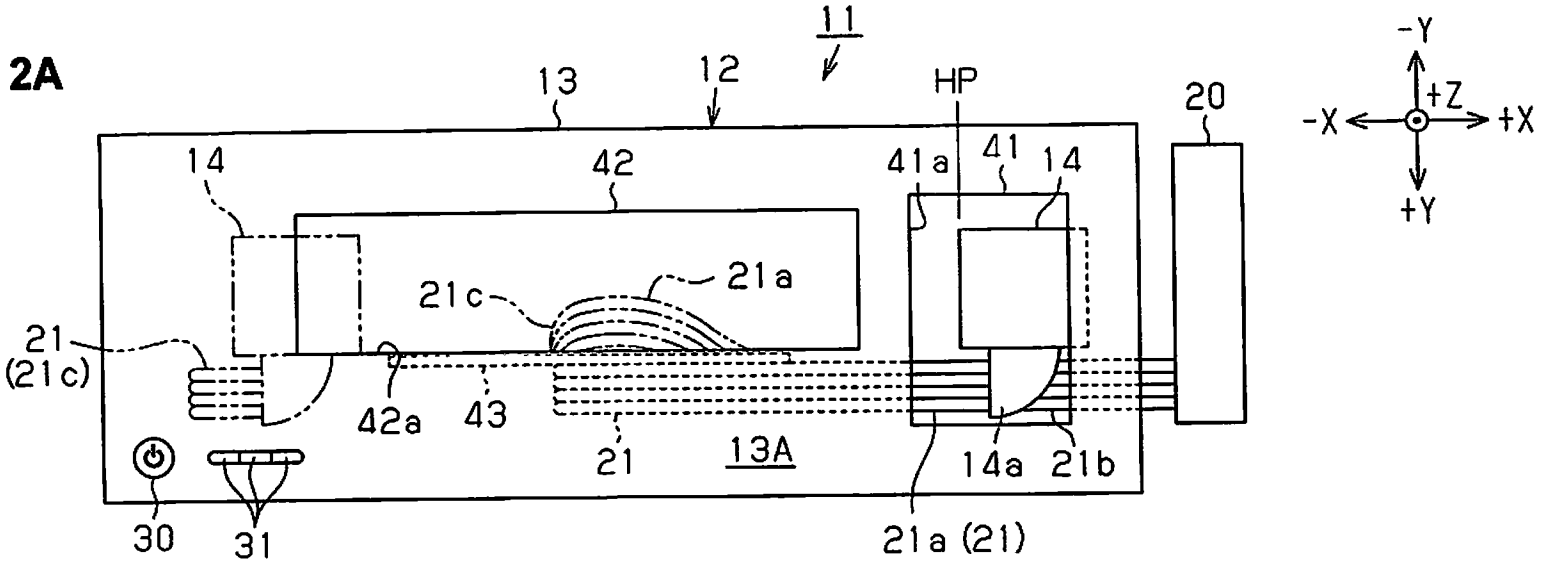
FIGS. 2A and 2B are schematic views of a printer where a carriage and a liquid supply tube are arranged inside a housing, FIG. 2A being a plan view and FIG. 2B being a front view in which the housing is displayed in cross-section.
Figure 2B:
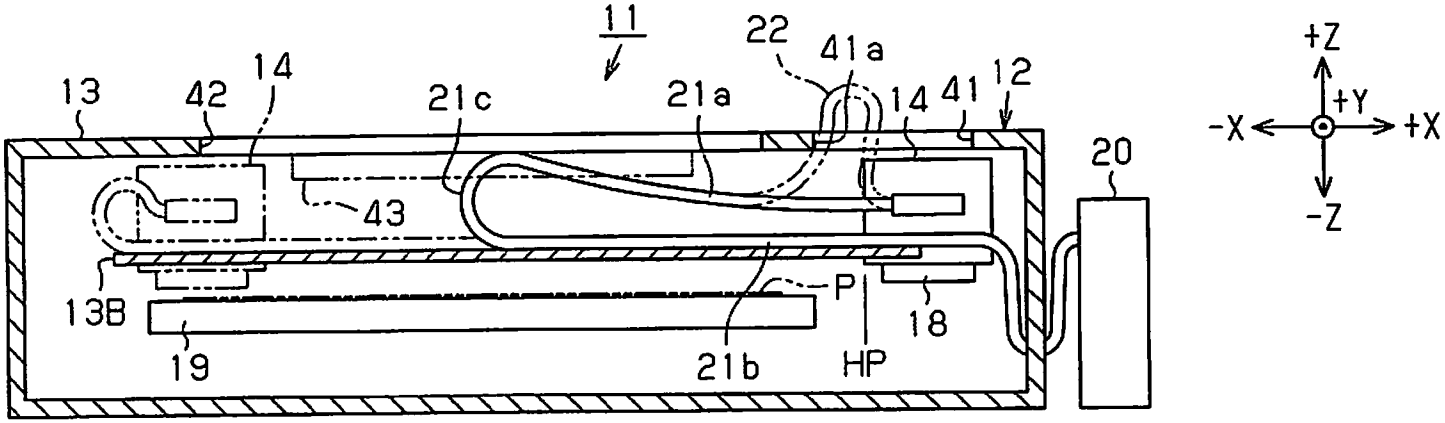

As illustrated in FIGS. 2A and 2B, a first opening section 41 is provided to the printer 11 at an upper surface section 13A of the case body 13, causing one end of the upper tube portions 21*a* connected to the tube connection section 14*a* to be exposed so as to be viewable when the carriage 14 is located at the home position illustrated with the reference sign HP in the FIG. 2A. This first opening section 41 forms an opening shape having an opening edge 41*a* that extends in a direction intersecting with the direction of movement of the carriage 14 at a rim portion on the counter-home position side (−X direction side) thereof.

Also provided to the upper surface section 13A of the case body 13 is a second opening section 42 of an opening shape having an opening edge 42*a* that extends along the scan direction at a position where at least a part of the movement region of the carriage 14 where there is movement during printing is exposed so as to be viewable and where the liquid supply tubes 21 connected to the carriage 14 are not exposed. In the present embodiment, the second opening section 42 opens with a size (length) with which it is possible to view the carriage 14 moving from a home position-side zero length to a counter-home position-side full length, out of the range of motion during printing. The second opening section 42 also has an opening surface area of a size that allows for the paper P inside the case body 13 to be taken out to outside the case body 13.

Provided to at least a part of the opening edge 42*a* of this second opening section 42 is a rib 43 that projects out downward and extends rectilinearly along the scan direction (±X direction), at a lower surface side of the upper surface section 13A of the case body 13. The liquid supply tubes 21 are connected in the front-back direction (±Y direction), which intersects with the direction of movement of the carriage 14, to the rib 43, thereby regulating movement toward the second opening section 42 when the carriage 14 is moving reciprocally. In the present embodiment, the liquid supply tubes 21 are configured so that the curved sections 21*c* and/or the upper tube portions 21*a* located on the downstream side from the curved sections 21*c* are in contact with the rib 43.

The rib 43 is provided at a height where is no interference with the tube connection section 14*a* of the moving carriage 14.

The movement of the liquid supply tubes 21 in the vertical direction (±Z direction) is regulated by the housing of the printer main body 12. Namely, upward movement by the curved sections 21*c* and the upper tube portions 21*a* is regulated by the upper surface section 13A of the case body 13. Downward movement by the curved sections 21*c* and the lower tube portions 21*b* is regulated by a guide plate 13B serving as one housing provided to the printer main body 12.

In other words, the liquid supply tubes 21 are arranged inside the case body 13 where the position of arrangement is a position at which the liquid supply tubes 42 are not exposed in a state of being viewable from the second opening section 42 and at which the liquid supply tubes 42 are retained in front of the second opening section 42 by the upper surface section 13A and the guide plate 13B of the case body 13.

Figure 3:
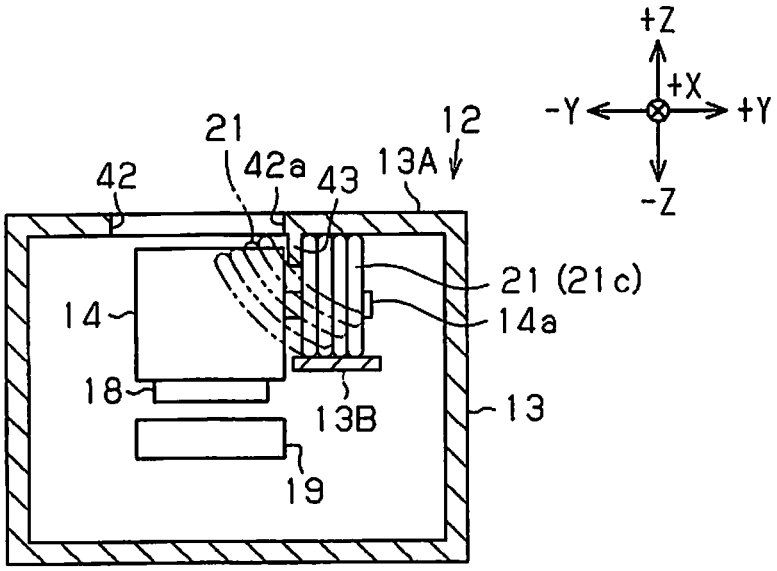
FIG. 3 is a lateral cross-sectional view of a printer where a carriage and a liquid supply tube are arranged inside a housing.

Being retained at the position of arrangement inside the case body 13, the liquid supply tubes 21 may in some instances—for example, during transport of the printer—enter a state where a part of the upper tube portions 21*a* protrudes out of the case body 13 via the first opening section 41 from the position of arrangement inside the case body 13, as illustrated with the two-dot chain line in FIG. 2B. Alternatively, as illustrated with the two-dot chain line in FIGS. 2A and 3, there may be instances where a part of the curved sections 21*c* or the upper tube portions 21*a* surpasses the rib 43 from the position of arrangement inside the case body 13 and moves toward the second opening section 42 side.

Therefore, in the present embodiment, a movement control process for returning the liquid supply tubes 21 having left the position of arrangement in this manner to the original position of arrangement is performed. This movement control process shall be described below with reference to the accompanying drawings, as shall effects thereof.

This movement control process is carried out before a print operation is started in the printer 11, e.g., after a power-on operation from the power source button 30 of the printer 11, after an input operation to start printing from the operation buttons 31, or the like. This process is carried out by the control unit driving the drive source 16 so as to reciprocally move the carriage 14 in the scan direction. As such, the control unit functions as a movement control unit for the carriage 14.

Figure 4:
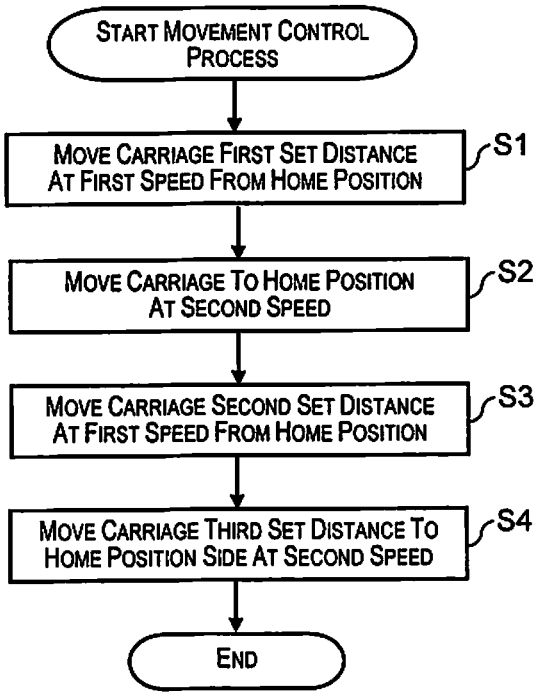
FIG. 4 is a flow chart illustrating a movement control process for a carriage that is carried out by a control unit.

As illustrated in FIG. 4, when the movement control process is started, first, in a step S1, a process for moving the carriage a first set distance from the home position at a first speed is carried out. Herein, the control unit (movement control unit) drives the drive source 16 to rotate the drive belt 17, and moves the carriage 14, which is located at the home position when the power is turned on, by an amount commensurate with a first set distance L1 that has been previously set at a first speed V1 toward the counter-home position side (full length side) in the scan direction.

Figure 5A:
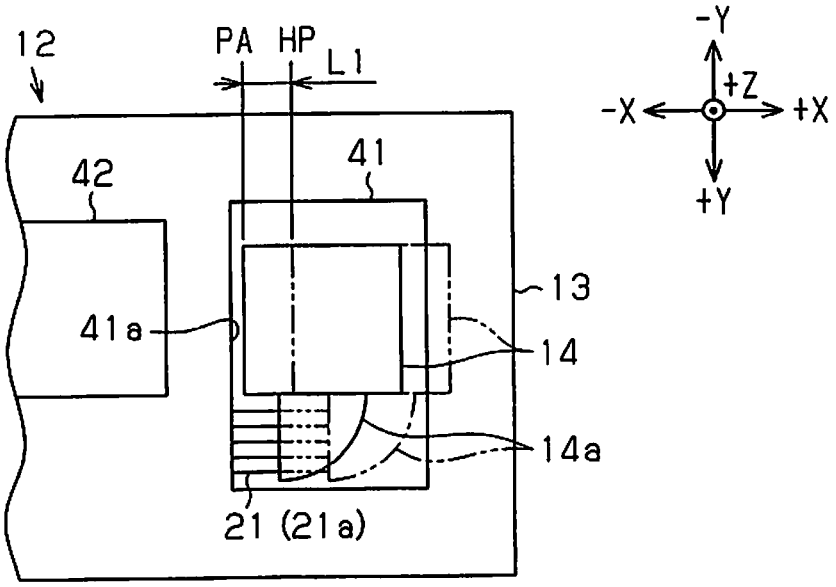
FIGS. 5A to 5C are descriptive views illustrating movement of a carriage and a liquid supply tube when movement is controlled.

As illustrated in FIG. 5A, in the present embodiment, the first set distance L1 is set to a distance that is shorter than a movement distance by the carriage 14 until one end of the liquid supply tubes 21 (the upper tube portions 21*a*) overlaps in the scan direction (±X direction) with the opening edge 41*a* of the first opening section 41 from the home position illustrated the reference sign HP. In other words, the control unit controls movement within a range of motion by the carriage 14 from the home position until when one end of the liquid supply tubes 21 overlaps in the scan direction with the opening edge 41*a* of the first opening section 41. Herein, this is a position in advance of a position at which the counter-home position-side end of the carriage overlaps in the scan direction with the opening edge 41*a* of the first opening section 41, as illustrated with the reference sign PA.

Returning to FIG. 4, in the next step S2, a process for moving the carriage 14 to the home position at a second speed is carried out. Herein, the control unit drives the drive source 16 to rotate the drive belt 17, and moves the carriage 14, which was moved to the counter-home position side by an amount commensurate with the first set distance L1 by the process of the step S1, so as to return to the home position. At this time, the moving speed of the moving carriage 14 is a second speed V2 that is faster than the first speed V1.

Figure 5B:
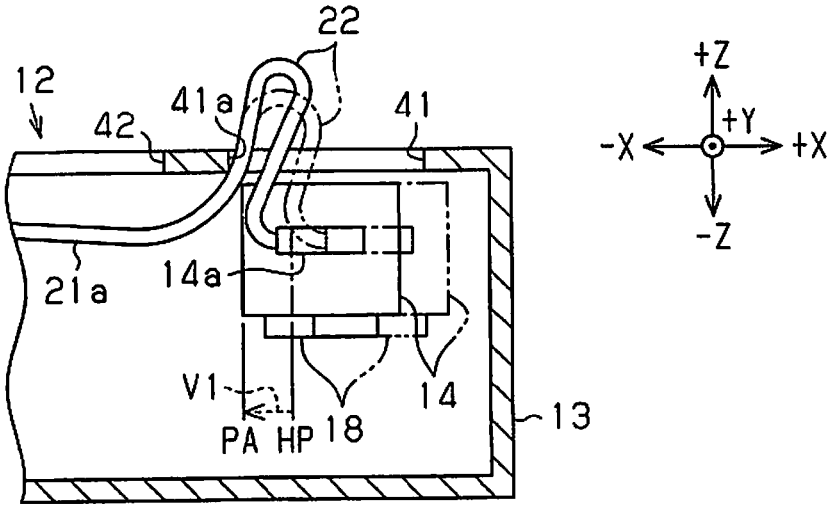
Figure 5C:
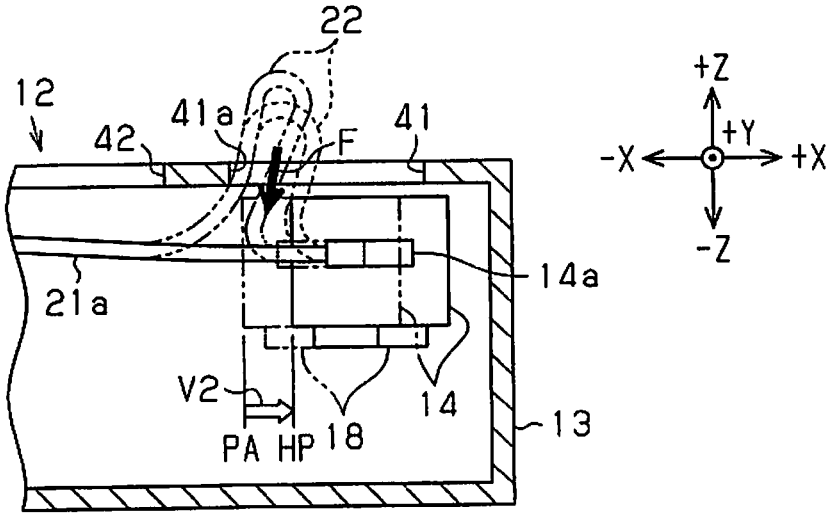

As illustrated in FIGS. 5B and 5C, the processes according to the step S1 and the step S2 cause the liquid supply tubes 21, having entered a state of protruding outside the case body 13 in the first opening section 41, to move so as to return to the original position of arrangement inside the case body 13.

In an example illustrated by the two-dot chain line in FIG. 5B, in a state where the carriage 14 is located at the home position illustrated with the reference sign HP, a liquid supply tube 21 is assumed to have the upper tube portion 21*a* protruding out of the case body 13 in a substantially U-shaped form in the vicinity of the portion of connection with the tube connection section 14*a* and abutting against the opening edge 41*a*, thus producing a bending portion 22.

Regarding this bending portion 22, when the carriage 14 moves slowly at the first speed V1 by an amount commensurate with the first set distance L1 toward the position illustrated with the reference sign PA from the position of the home position, the bending portion 22 is squished, and the squished bending portion 22 slowly rises as illustrated with the solid line in FIG. 5B. In the present embodiment, the amount by which the bending portion 22 rises substantially peaks in the state where the carriage 14 has moved to the position illustrated with the reference sign PA.

Next, as illustrated in FIG. 5C, when the carriage 14 moves quickly at the second speed V2 to the home position illustrated with the reference sign HP from the position illustrated with the reference sign PA, this causes the upper tube portion 21*a*, where the bending portion 22 has risen, to descend while also releasing the state in which the bending portion 22 has been squished, as illustrated with the broken line in FIG. 5C. At this time, the quick moving of the carriage 14 causes the bending portion 22 to also descend quickly. Therefore, the inertial force associated with the movement of the bending portion 22 causes a downward force F to act on the protruding upper tube portion 21*a*. As such, the action of this force F causes the upper tube portion 21*a* (liquid supply tube 21) to be returned to the position of arrangement inside the case body 13, as illustrated with the solid line in FIG. 5C.

Returning to FIG. 4, next, in a step S3, a process for moving the carriage 14 a second set distance at the first speed from the home position is carried out. Herein, the control unit drives the drive source 16 to rotate the drive belt 17, and moves the carriage 14, which is located at the home position, at the first speed V1 by an amount commensurate toward a previously set second set distance L2 toward the counter-home position side (full length side) in the scan direction.

Figure 6A:
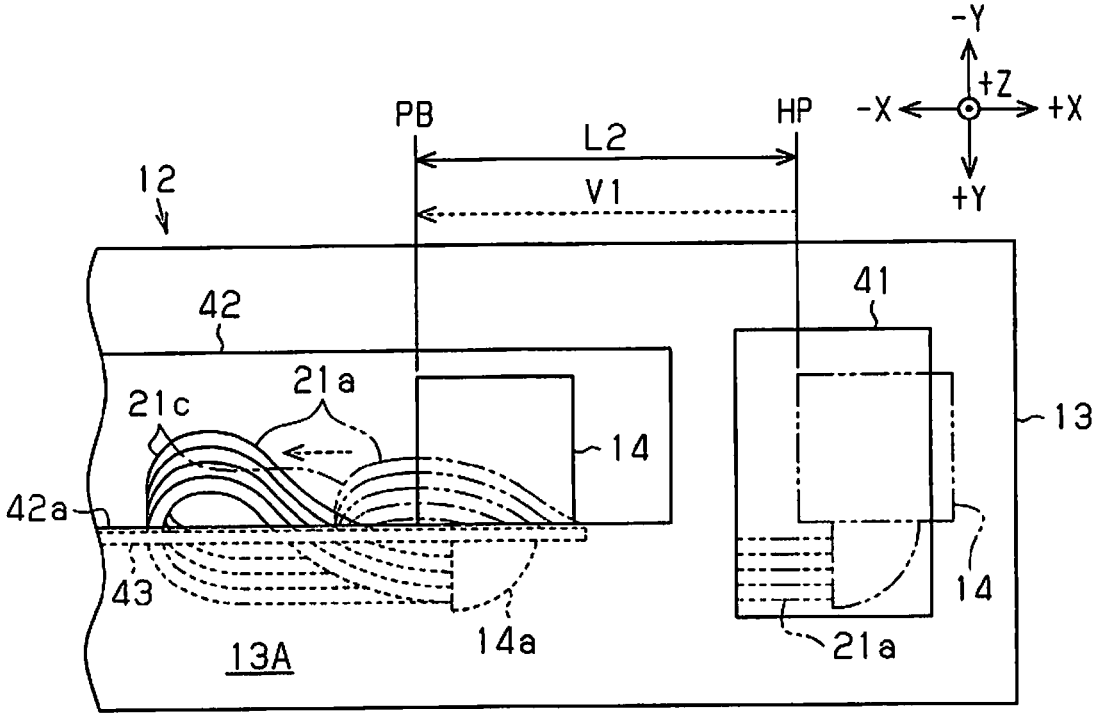
FIGS. 6A and 6B are descriptive views illustrating movement of a carriage and a liquid supply tube when movement is controlled.

As illustrated in FIG. 6A, in the present embodiment, the second set distance L2 is set to a distance by which the carriage 14 moves from the home position illustrated with the reference sign HP until reaching a state where at least a part of the carriage 14 can be viewed from the second opening section 42. In other words, the control unit controls movement within a range of motion by the carriage 14 from the position before the start of printing until reaching a state where the carriage 14 is at least partially exposed at the second opening section 42. Herein, as illustrated with the reference sign PB, this is understood to be a configuration where the home position-side end of the carriage 14 moves to a position apart from the right-side (+X direction-side) opening edge of the second opening section 42 in the scan direction.

Returning to FIG. 4, in the next step S4, a process for moving the carriage 14 a third set distance to the home position side at the second speed is carried out. Herein, the control unit drives the drive source 16 to rotate the drive belt 17, and moves the carriage 14, which has been moved by an amount commensurate with the second set distance L2 to the counter-home position side, at the second speed V2 faster than the first speed V1 by an amount commensurate with a previously set third set distance L3 to the home position side.

Figure 6B:
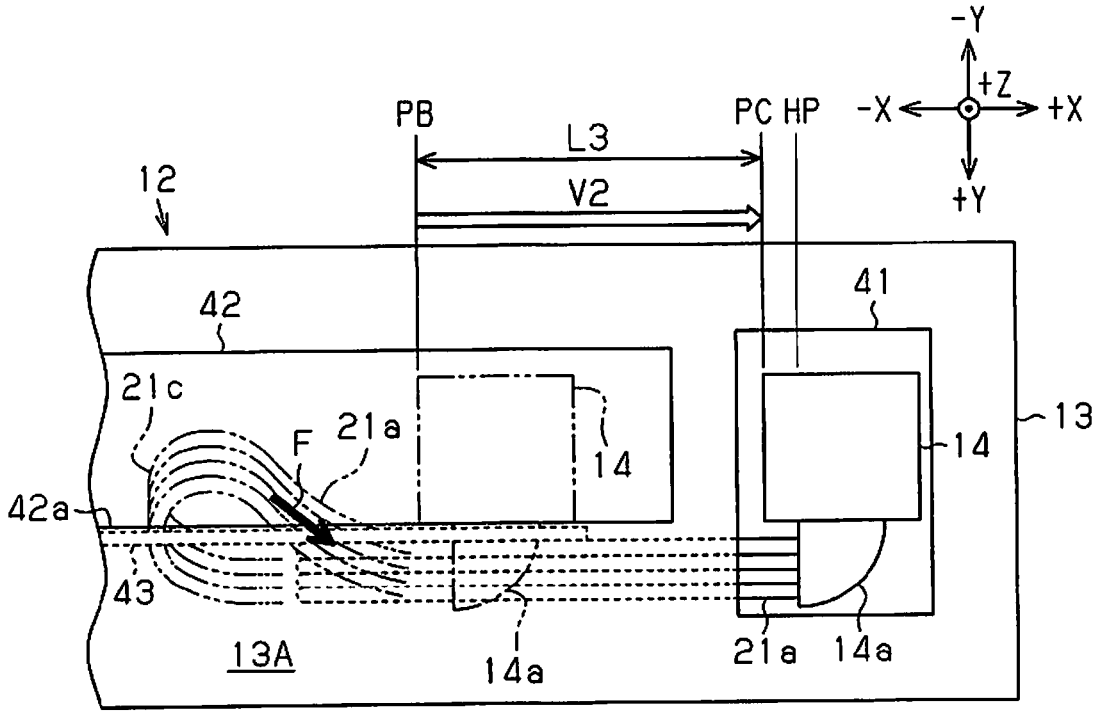

As illustrated in FIGS. 6A and 6B, the processes according to the step S3 and the step S4 cause the liquid supply tubes 21, which have reached a state of having moved so that the curved sections 21*c* thereof surpass the rib 43 and are exposed at the second opening section 42, to move so as return to the original position of arrangement inside the case body 13.

Namely, as illustrated with the two-dot chain line in FIG. 6A, in the state where the carriage 14 is located at the home position illustrated with the reference sign HP, the state is assumed to be one where the curved sections 21*c* or the upper tube portions 21*a* of the liquid supply tubes 21 have moved to the second opening section 42 side beyond the rib 43 and are exposed. The exposed portions of the curved sections 21*c* or the upper tube portions 21*a* move along the scan direction toward the full length side (−X direction-side) when the carriage 14 moves the second set distance L2 at the slower first speed V1 toward the full length side (−X direction side), being the counter-home position side, from the home position. In other words, as illustrated with the solid line in FIG. 6A, the carriage, having moved to an exposed state in the second opening section 42, causes the exposed portions of the liquid supply tubes 21 to move toward the counter-home position-side full length side (−X direction side) in the scan direction.

Next, in association with the moving of the carriage 14 at the second speed V2 to the home position-side position illustrated with the reference sign PC in FIG. 6B, the exposed portions of the liquid supply tubes 21 having moved to the full length side are likewise moved to the home position side. During this motion, because the carriage 14 is moving quickly, the upper tube portions 21*a* that are located at the position of arrangement, connected to the tube connection section 14*a* of the carriage 14, also move quickly. As a result, the upper tube portions 21*a*, moving quickly in the position of arrangement, cause the force F in the direction going toward the position of arrangement to act on a part of the curved sections 21*c* or upper tube portions 21*a* that are the exposed portions illustrated with the two-dot chain line in FIG. 6B. The action of this force F, as illustrated with the broken line in FIG. 6B, causes the exposed portions of the curved sections 21*c* or the tube portions 21*a* to be returned so as to be pulled in to the position of arrangement inside the case body 13. In other words, moving the carriage 14 to a state of exposure at the second opening section 42 and therefore moving the carriage 14 to the home position side makes it possible to precisely return the exposed portions of the liquid supply tubes 21 with high probability to the position of arrangement.

At this time, the liquid supply tubes 21 (upper tube portions 21*a*) being returned to the position of disposition are moved beyond the rib 43, thereby again enacting a state of regulation by the rib 43 so as not to move to the second opening section 42 side. In this manner, in the present embodiment, the control unit controls movement within a range of motion by the carriage 14 where the liquid supply tubes 21 can be contacted with the rib 43. Preferably, as regards a rear-side (−Y direction-side) rib surface of the rib 43, an inclined surface where the distal end thereof is located further forward (+Y direction side) than the proximal end is provided by tapering, chamfering, or the like to the portion of surpassing by the liquid supply tubes 21 being returned to the position of disposition.

In this movement control, in the present embodiment, the second speed V2 in the step S2 is a speed about 80-fold the first speed V1 in the step S1. The second speed V2 in the step S4 is also a speed about five-fold the first speed V1 in the step S3. The second speed V2 in the step S2 and the second speed V2 in the step S4 are understood to be the same speed; as such, the first speed V1 in the step S3 is understood to be a speed that is about 16-fold the first speed V1 in the step S1. It shall be readily understood that it suffices for the first speed V1 and the second speed V2 in the respective steps to be speeds that allow for the liquid supply tubes 21 to each be returned to the position of arrangement inside the case body 13. The first speed V1 in the step S3 is preferably a speed that makes it possible for tube portions that have protrude out into the movement region of the carriage 14 to be moved in an unencumbered manner to the counter-home position side along the scan direction in association with the movement of the carriage 14, and may be a speed that is slower than or faster than 16-fold the first speed V1 in the step S1.

Similarly, it likewise suffices for the first set distance L1 and the second set distance L2 to be set to distances that allow for the liquid supply tubes 21 (upper tube portions 21*a*) to each be returned to the position of arrangement inside the case body 13. It also suffices for the third set distance L3 to be a distance that allows for the liquid supply tubes 21 (upper tube portions 21*a*) to be returned to the position of arrangement inside the case body 13. In the present embodiment, the third set distance L3 was a distance by which the carriage 14 moves until the home position-side where printing onto the paper P is started, i.e., a position corresponding to the zero length. That is to say, the printer 11 has entered a state where printing can be started immediately after the control unit (movement control unit) has finished the movement control process for the carriage 14.

According to the first embodiment above, the following effects can be obtained.

(1) Even when the liquid supply tubes 21 have left the position of arrangement inside the case body 13, where the movement of the carriage 14 is not hindered, the movement control of the carriage 14 makes it possible to return the liquid supply tubes 21 to the position of arrangement before the start of printing. As a result, when the carriage 14 moves for the purpose of printing, it is possible to prevent hindrance of this movement of the carriage 14.

(2) With a liquid supply tube 21 with which a part of the tube portion has protruded to outside the case body 13 via the first opening section 41, the part of the tube portion (upper tube portion 21*a*) that has protruded out can be returned to the position of arrangement inside the case body 13 in association with the movement control of the carriage 14.

(3) A liquid supply tube 21 that has protruded out into the movement region of the carriage 14 from the position of arrangement inside the case body 13 can be viewed from the second opening section 42. It is also possible to accurately control movement so as to return, to the position of arrangement, a liquid supply tube 21 that has protruded out into the movement region of the carriage 14 due to the carriage 14 having moved to a state of exposure at the second opening section 42.

(4) A liquid supply tube 21 that has protruded out into the movement region of the carriage 14 from the position of arrangement can be easily viewed from the second opening section 42, and also, for example, jammed paper P can be taken out of the case body 13 from the second opening section 42 and removed from the movement region of the carriage 14.

(5) When a liquid supply tube 21 that has protruded out into the movement region of the carriage 14 from the position of arrangement inside the case body 13 has been returned to the position of arrangement inside the case body 13 by the movement control of the carriage 14, there is a higher probability of being maintained at the position of arrangement to which the liquid supply tube 21 was returned.

(6) A liquid supply tube 21 that has moved in the direction running along the support surface 19S and left the position of arrangement inside the case body 13 can be returned to the position of arrangement at high probability due to the upper tube portion 21*a*, which is arranged so as to overlap in the normal direction of the support surface 19S.

(7) The plurality of liquid supply tubes 21, being arranged inside the case body 13 successively in the direction running along the support surface 19S of the support base 19 for supporting the paper P, can be returned to the position of arrangement inside the case body 13 at the same time due to the movement control process.

The embodiment described above may also be modified to another embodiment, such as the following.

In the embodiment described above, there need not necessarily be a plurality of liquid supply tubes 21 provided continuously in the direction running along the support surface 19S of the support base 19 for supporting the paper P. For example, there may be a plurality of liquid supply tubes 21 provided successively in the normal direction of the support surface 19S of the support base 19. The present modification example shall be described with reference to the accompanying drawing.

Figure 7:
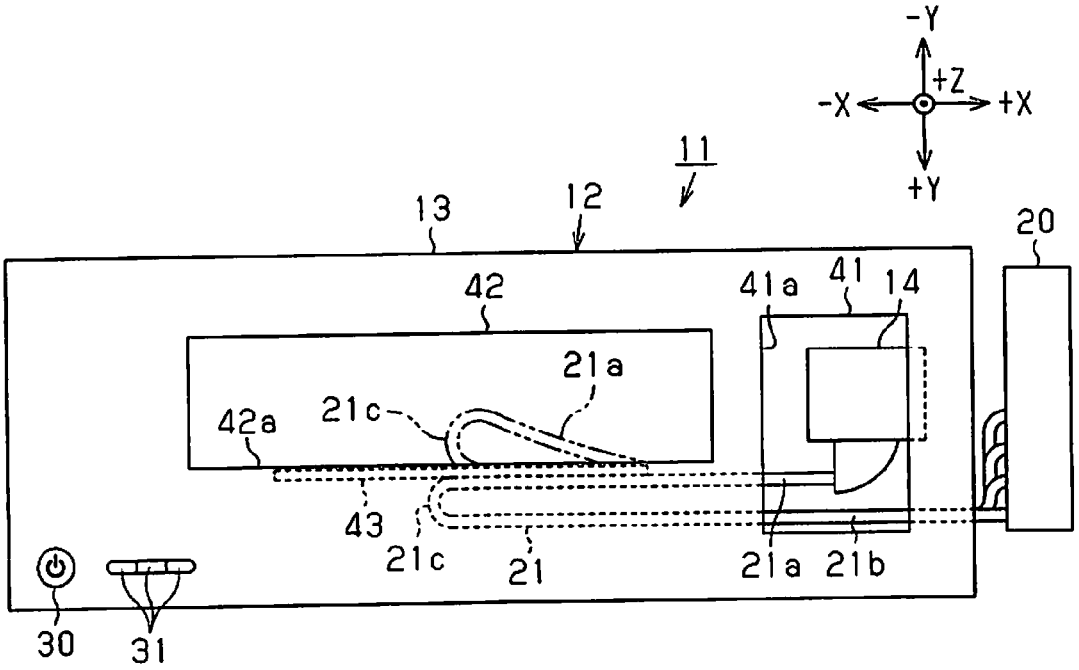
FIG. 7 is a plan view of a printer illustrating a modification example for a state of arrangement of a liquid supply tube.

As illustrated in FIG. 7, the printer 11 of the present modification example has the plurality of liquid supply tubes 21 arranged in a successive state in the up-down direction (±Z direction), which is the normal direction with respect to the support surface 19S of the support base in the case body 13. The liquid supply tubes 21 are also arranged inside the case body 13 in a state where the direction of extension of the tubes, which intersects with the direction of succession of each of the liquid supply tubes 21, runs along the direction of movement of the carriage 14, i.e., along the scan direction (±X direction). Formed in the liquid supply tubes 21 are the curved sections 21*c* at which the convex surface goes toward the counter-home position direction (−X direction) at a portion on the upstream side from the tube connection section 14*a* of the carriage 14. The liquid supply tubes 21 are also arranged in a state where the downstream-side (rear-side) tube portions 21*a* and upstream-side (front-side) tube portions 21*b* located at both ends of the curved sections 21*c* at least partially overlap with one another as seen from the direction of conveyance (+Y direction) of the paper P, which is the forward direction.

As such, in the case of a configuration where the downstream-side tube portions 21*a* from the curved sections 21*c* are not guided by the guide plate 13B, it could happen that the liquid supply tubes 21 of the present modification example could surpass the rib 43 due to lowering by the downstream-side tube portions 21*a*, leaving the position of arrangement and moving to the second opening section 42 side. A description is omitted herein, but in such a case, as well, carrying out the movement control process for the carriage 14 in the embodiment described above would make it possible to move the liquid supply tubes 21 (downstream-side tube portions 21*a*) to the position of arrangement.

In the present modification example, though the probability of the downstream-side tube portions 21*a* protruding to outside the case body 13 from the first opening section 41 is low, in a case where the downstream-side tube portions 21*a* do protrude, carrying out the movement control process for the carriage 14 in the embodiment described above would make it possible to return the protruding tube portions 21*a* to the position of arrangement.

In the embodiment described above, the first opening section 41 having the opening edge 41*a* that extends in a direction intersecting with the direction of movement of the carriage 14 on the counter-home position side need not necessarily be provided to the case body 13.

Figure 8:
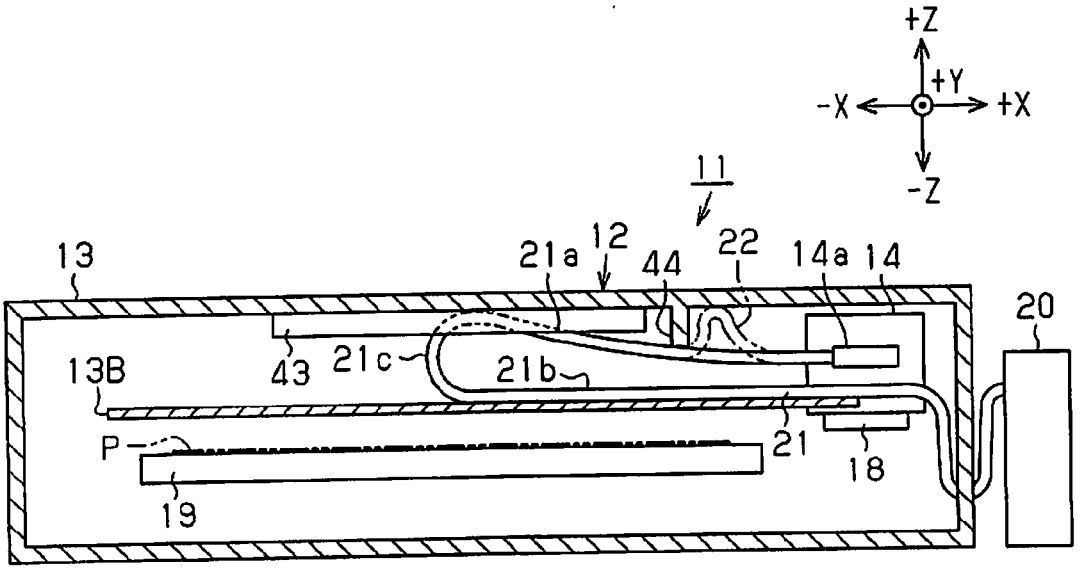
FIG. 8 is a front view of a printer having a housing in which an opening section is not formed, in a modification example.

For example, as illustrated in FIG. 8, there is a case where a rib 44 that is located on the upper side of the upper tube portions 21*a* and extends in a direction intersecting with the direction of movement of the carriage 14 is formed projecting downward at the upper surface section 13A of the case body 13. In such a case, as illustrated with the two-dot chain line in FIG. 8, it could happen that the upper tube portions 21*a* could abut so as to interfere with the rib 44, thus forming the bending portion 22 of the tubes. Therefore, in such a case, carrying out the movement control process for the carriage 14 in the embodiment described above would make it possible to return the liquid supply tubes 21 (upper tube portions 21*a*) to the position of arrangement. It shall be readily understood that the first speed V1, the second speed V2, and the first set distance L1 are each set to values that make it possible to return the bending portions 22 to the position of arrangement.

In the embodiment described above, the second opening section 42 for at least partially exposing the movement region of the carriage 14 need not necessarily be provided to the case body 13.

For example, even in a case where the second opening section 42 is not formed, there would still be cases where, as illustrated with the broken line in FIG. 8, a part of the curved sections 21*c* or the upper tube portions 21*a* surpasses the rib 43, moving to inside the movement region of the carriage 14 located on the rear side thereof, and thus entering a state of not being returned to the position of arrangement. Therefore, in such a case, carrying out the movement control process for the carriage 14 in the embodiment described above would make it possible to return the liquid supply tubes 21 to the position of arrangement. It shall be readily understood that the first speed V1, the second speed V2, the second set distance L2, and the third set distance L3 are each set to values that make it possible to return the moved part of the curved sections 21*c* or the upper tube portions 21*a* to the position of arrangement.

In the embodiment described above, the curved sections 21*c* need not necessarily be formed in the liquid supply tubes 21. For example, a depiction is omitted here, but there would be a case where the ink tank 20 is disposed on the left side of the case body 13 (−X direction side) as seen from the direction of conveyance (+Y direction) of the paper P, and the liquid supply tubes 21 are arranged over a long distance from the left end of the case body 13 until the tube connection section 14*a* along the scan direction. In such a case, the liquid supply tubes 21 are arranged in a state extending substantially rectilinearly along the scan direction in the case body 13. As such, it would happen that a part of the liquid supply tubes 21 protrudes out from the first opening section 41 due to curving when the tube portions extending long and rectilinearly move in the scan direction in association with the movement of the carriage 14. Alternatively, it could happen that bending back and forth of the liquid supply tubes 21 causes the bent tube portions to enter the movement region of the carriage 14. In such a case, carrying out the movement control process for the carriage 14 in the embodiment described above would make it possible to return the liquid supply tubes 21 to the position of arrangement.

In the embodiment described above, the second opening section 42 need not necessarily have an opening surface area of a size that allows for the paper P inside the case body 13 to be taken out of the case body 13. For example, the opening surface area may be of a size that allows for at least a part of the carriage 14 moving in the scan direction to be viewed. Preferably, the opening surface area is of a size that allows for viewing of the liquid supply tubes 21 that have deviated to the second opening section 42 side from the position of arrangement.

In the embodiment described above, the rib 43 for retaining the liquid supply tubes 21 at the position away from the movement region of the carriage 14 need not necessarily be provided to the case body 13. For example, in a case where a large number of liquid supply tubes 21 are arranged successively in the direction running along the support surface 19S of the support base 19, then the liquid supply tubes 21 are unlikely to experience deformation to the direction running along the support surface 19S, and there is therefore a higher probability of the liquid supply tubes 21 being maintained at the position of arrangement even in the absence of the rib 43. It thus follows that the rib 43 is not necessary in such a case. In a case where the rib 43 is not provided, it could happen that the liquid supply tubes 21 are retained in a state of contacting with (abutting against) the opening edge 42*a* of the second opening section 42 and leaving the position of arrangement to the rear thereof (−Y direction) (see FIG. 3). In such a case, the movement control process makes it possible to return the liquid supply tubes 21 to the position of arrangement.

In the embodiment and modification examples described above, there may be a plurality other than four (for example, two or five) of the liquid supply tubes 21. Alternatively, instead of a plurality, there may be one liquid supply tube 21. In a case where there is one liquid supply tube 21, then, for example, in the embodiment described above, a strip of film sheet is preferably stuck to the liquid supply tube 21 in a state where the sheet surface direction thereof is the direction running along the support surface 19S so as to prevent the curved section 21*c*, which moves in association with the movement of the carriage 14, from being twisted during movement. In a case where there are a plurality of liquid supply tubes 21, too, there may be a strip of film sheet that is stuck in a similar state to the liquid supply tubes 21. It shall be readily understood that the strip of film sheet is preferably stuck to the outer peripheral side of the curved sections 21*c* with respect to the liquid supply tubes 21, in order to reduce the frictional force with the case body 13 produced when the curved sections 21*c* move.

The printer 11 serving as a print apparatus of the embodiment described above may be a liquid discharge apparatus that discharges a liquid other than ink. The state of the liquid, which is discharged in the form of minute droplets from the liquid discharge apparatus, is understood to encompass one that leaves trails in a particulate, teardrop, or thread shape. Liquid as used here may be any material that can be discharged from a liquid discharge apparatus. For example, it suffices for the liquid to be a state when the substance is in the liquid phase, and high- or low-viscosity liquids, sols, gel waters, and other inorganic solvents, organic solvents, solutions, liquid resins, liquid metals (molten metals), and other liquid bodies are understood to be included. Not only liquids in the form of one state of a substance, but also solvents into which a functional material composed of a solid matter such as a pigment or metal particles has been dissolved or dispersed, or the like are also understood to be included. Representative examples of liquids include ink, such as was described in the embodiment above, or liquid crystals and the like. Herein, the term "ink" encompasses a variety of compositions in the form of a liquid, such as general water-soluble inks and oil-soluble inks as well as gel inks, hot melt inks, and the like. Specific examples of liquid discharge apparatuses include liquid discharge apparatuses for discharging a liquid including, in a dispersed or dissolved form, a material such as an electrode material or coloring material used in the manufacture of liquid crystal displays, electroluminescence (EL) displays, field emission displays, or color filters. Other examples may include a liquid discharge apparatus for discharging a biological organic matter used to manufacture biochips; a liquid discharge apparatus for discharging a liquid serving as a sample, used as a precision pipette; or a printing device, a micro-dispenser, or the like. Further examples include: a liquid discharge apparatus for ejecting a lubricant at pin points for a precision machine such as a timepiece or camera; or a liquid discharge apparatus for discharge a transparent resin solution such as an ultraviolet curable resin onto a substrate in order to form, inter alia, a hemispherical micro lens (optical lens) used in an optical communication element or the like. Another example may be a liquid discharge apparatus for discharging an acid or alkali etching solution in order to etch a substrate or the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A print apparatus comprising:

a carriage having a liquid discharge head configured and arranged to discharge a liquid and to move reciprocally along one direction;

a liquid supply tube configured and arranged to supply the liquid to the liquid discharge head, one end of the liquid supply tube being connected to the carriage;

a housing in an interior of which the carriage and at least a part of the liquid supply tube are arranged; and a movement control unit configured to control reciprocal movement of the carriage, the liquid supply tube being connected to the carriage from a counter-home position side that is an opposite side in the one direction to a home position side at which the carriage is located before start of printing in which the liquid is discharged onto a target from the liquid discharge head, and the movement control unit being configured to carry out a movement control, before the start of printing, to cause the carriage to move for a set distance at a first speed toward the counter-home position side from the home position side, and then to move at a second speed faster than the first speed toward the home position side from the counter-home position side, the set distance being shorter than a distance between the home position and a point at which a part of the carriage reaches a curved section of the liquid supply tube when the carriage moves toward the counter-home position side from the home position side, the set distance being shorter than a distance between the home position and a point at which a part of the carriage reaches an end of the target when the carriage moves toward the counter-home position side from the home position side, the curved section being a curved section formed when the carriage is located at the home position.

2. The print apparatus as set forth in claim 1, wherein the housing includes a first opening section through which the one end of the liquid supply tube connected to the carriage is exposed so as to be viewable when the carriage is located at a home position, the first opening section having an opening edge extending in a direction intersecting with a direction of movement of the carriage at a counter-home position-side rim portion thereof, and the movement control unit is configured to carry out the movement control within a range of motion of the carriage from the home position until when the one end of the liquid supply tube overlaps in the one direction with the opening edge of the first opening section.

3. The print apparatus as set forth in claim 1, wherein the housing includes a second opening section through which at least a part of a movement region of the carriage that moves during the printing is exposed so as to be viewable, the second opening section having an opening edge extending along the one direction at a position where the liquid supply tube connected to the carriage is not exposed, and the movement control unit is configured to carry out the movement control within a range of motion of the carriage from a position of the carriage before the start of printing until when the carriage enters a state of being at least partially exposed at the second opening section.

4. A print apparatus comprising:

a carriage having a liquid discharge head configured and arranged to discharge a liquid and to move reciprocally along one direction;

a liquid supply tube configured and arranged to supply the liquid to the liquid discharge head, one end of the liquid supply tube being connected to the carriage;

a housing in an interior of which the carriage and at least a part of the liquid supply tube are arranged; and a movement control unit configured to control reciprocal movement of the carriage, wherein the liquid supply tube is connected to the carriage from a counter-home position side that is an opposite side in the one direction to a home position side at which the carriage is located before start of printing in which the liquid is discharged onto a target from the liquid discharge head, and the movement control unit is configured to carry out a movement control, before the start of printing, to cause the carriage to move at a first speed toward the counter-home position side from the home position side, and then to move at a second speed faster than the first speed toward the home position side from the counter-home position side, the housing includes a first opening section through which the one end of the liquid supply tube connected to the carriage is exposed so as to be viewable when the carriage is located at a home position, the first opening section having an opening edge extending in a direction intersecting with a direction of movement of the carriage at a counter-home position-side rim portion thereof, and the movement control unit is configured to carry out the movement control within a range of motion of the carriage from the home position until when the one end of the liquid supply tube overlaps in the one direction with the opening edge of the first opening section.

5. A print apparatus comprising:

a carriage having a liquid discharge head configured and arranged to discharge a liquid and to move reciprocally along one direction;

a liquid supply tube configured and arranged to supply the liquid to the liquid discharge head, one end of the liquid supply tube being connected to the carriage;

a housing in an interior of which the carriage and at least a part of the liquid supply tube are arranged; and a movement control unit configured to control reciprocal movement of the carriage, wherein the liquid supply tube is connected to the carriage from a counter-home position side that is an opposite side in the one direction to a home position side at which the carriage is located before start of printing in which the liquid is discharged onto a target from the liquid discharge head, and the movement control unit is configured to carry out a movement control, before the start of printing, to cause the carriage to move at a first speed toward the counter-home position side from the home position side, and then to move at a second speed faster than the first speed toward the home position side from the counter-home position side, the housing includes a second opening section through which at least a part of a movement region of the carriage that moves during the printing is exposed so as to be viewable, the second opening section having an opening edge extending along the one direction at a position where the liquid supply tube connected to the carriage is not exposed, and the movement control unit is configured to carry out the movement control within a range of motion of the carriage from a position of the carriage before the start of printing until when the carriage enters a state of being at least partially exposed at the second opening section.

6. A print apparatus comprising:

a carriage having a liquid discharge head configured and arranged to discharge a liquid and to move reciprocally along one direction;

a liquid supply tube configured and arranged to supply the liquid to the liquid discharge head, one end of the liquid supply tube being connected to the carriage;

a housing in an interior of which the carriage and at least a part of the liquid supply tube are arranged; and a movement control unit configured to control reciprocal movement of the carriage, the liquid supply tube being connected to the carriage from a counter-home position side that is an opposite side in the one direction to a home position side at which the carriage is located before start of printing in which the liquid is discharged onto a target from the liquid discharge head, and the movement control unit being configured to carry out a movement control for returning the liquid supply tube to a position of arrangement at which the liquid supply tube does not hinder movement of the carriage, before the start of printing, to cause the carriage to move for a set distance at a first speed toward the counter-home position side from the home position side, and then to move at a second speed faster than the first speed toward the home position side from the counter-home position side, the set distance being a distance within which the carriage is located on the home position side from the counter-home position, the set distance being shorter than a distance between the home position and a point at which a part of the carriage reaches an end of the target when the carriage moves toward the counter-home position side from the home position side.

7. The print apparatus as set forth in claim 6, wherein the housing includes a first opening section through which the one end of the liquid supply tube connected to the carriage is exposed so as to be viewable when the carriage is located at a home position, the first opening section having an opening edge extending in a direction intersecting with a direction of movement of the carriage at a counter-home position-side rim portion thereof, and the movement control unit is configured to carry out the movement control within a range of motion of the carriage from the home position until when the one end of the liquid supply tube overlaps in the one direction with the opening edge of the first opening section.

8. The print apparatus as set forth in claim 6, wherein the housing includes a second opening section through which at least a part of a movement region of the carriage that moves during the printing is exposed so as to be viewable, the second opening section having an opening edge extending along the one direction at a position where the liquid supply tube connected to the carriage is not exposed, and the movement control unit is configured to carry out the movement control within a range of motion of the carriage from a position of the carriage before the start of printing until when the carriage enters a state of being at least partially exposed at the second opening section.

* * * * *